US011090933B2

(12) United States Patent
Ozaki

(10) Patent No.: US 11,090,933 B2
(45) Date of Patent: Aug. 17, 2021

(54) LIQUID DISCHARGE HEAD AND LIQUID DISCHARGE HEAD MANUFACTURING METHOD

(71) Applicant: CANON KABUSHIKI KAISHA, Tokyo (JP)

(72) Inventor: Teruo Ozaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/787,544

(22) Filed: Feb. 11, 2020

(65) Prior Publication Data

US 2020/0262199 A1 Aug. 20, 2020

(30) Foreign Application Priority Data

Feb. 15, 2019 (JP) ..... JP2019-025706

(51) Int. Cl.
*B41J 2/14* (2006.01)
*B41J 2/16* (2006.01)

(52) U.S. Cl.
CPC ..... *B41J 2/14072* (2013.01); *B41J 2/1623* (2013.01); *B41J 2002/14491* (2013.01); *B41J 2202/18* (2013.01); *B41J 2202/22* (2013.01)

(58) Field of Classification Search
CPC ..... B41J 2/14072; B41J 2/1623; B41J 2002/14491; B41J 2202/18; B41J 2202/22
See application file for complete search history.

(56) References Cited

U.S. PATENT DOCUMENTS 8,162,444 B2 * 4/2012 Miura ..... B41J 2/14072 347/58

FOREIGN PATENT DOCUMENTS

JP 2005-41158 A 2/2005

* cited by examiner

*Primary Examiner* — Geoffrey S Mruk
(74) *Attorney, Agent, or Firm* — Canon U.S.A., Inc., IP Division

(57) ABSTRACT

A liquid discharge head that can prevent occurrence of cracks generated by a connection between an electrode pad and a wiring while reducing a manufacturing cost is provided. A bonding portion and a non-bonding portion are disposed at positions where the bonding portion and the non-bonding portion overlap an electrode and a coating film but do not overlap a through hole in a planar view of a liquid discharge head substrate.

9 Claims, 10 Drawing Sheets

LIQUID DISCHARGE HEAD AND LIQUID DISCHARGE HEAD MANUFACTURING METHOD

BACKGROUND OF THE INVENTION

Field of the Invention

The present disclosure relates to a liquid discharge head that discharges liquid and a method for manufacturing the same.

Description of the Related Art

A liquid discharge head (inkjet head) includes a liquid discharge head substrate and an electric wiring member (flexible wiring substrate such as a tape automated bonding (TAB) substrate). The liquid discharge head substrate includes an electrode pad to be used for an electrical connection with an outside. A wiring such as a lead disposed on the electric wiring member is bonded to the electrode pad. In this way, the liquid discharge head substrate is electrically connected with the electric wiring member.

Japanese Patent Application Laid-Open No. 2005-41158 discusses a technique that simultaneously connects electrode pads on a liquid discharge head substrate with leads on a TAB substrate by so-called gang bonding. The gang bonding, which is for simultaneously connecting the plurality of leads to the plurality of electrode pads, excels in mass production.

SUMMARY OF THE INVENTION

According to an aspect of the present disclosure, a liquid discharge head includes a liquid discharge head substrate including an element configured to discharge liquid, an electrode electrically connected to the element, an insulating coating film having a through hole and configured to cover the electrode, and an electrode pad configured for electrical connection with an outside and connected with the electrode via the through hole, the electrode pad being disposed on a side of the insulating coating film opposite to a side of the insulating coating film opposing the electrode, an electric wiring member including a wiring bonded to the electrode pad, a bonding portion where the electrode pad and the wiring are in contact with each other and bonded to each other, and a non-bonding portion where the electrode pad and the wiring are in contact with each other but not bonded to each other. The bonding portion and the non-bonding portion are disposed at positions where the bonding portion and the non-bonding portion overlap the electrode and the insulating coating film but do not overlap the through hole in a planar view of the liquid discharge head substrate.

Further features of the present disclosure will become apparent from the following description of exemplary embodiments with reference to the attached drawings.

DESCRIPTION OF THE EMBODIMENTS

An issue to be described below is caused by connecting an electrode pad with a wiring such as a lead.

Figure 10A:
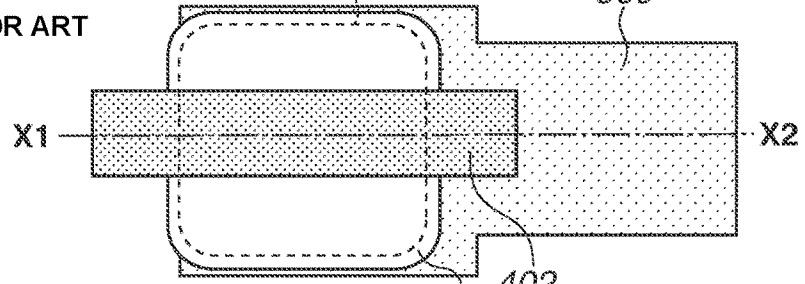
FIG.10A PRIOR ART
FIGS. 10A to 10E are diagrams for describing a connection between an electrode pad and a wiring on a conventional liquid discharge head.
Figure 10B:
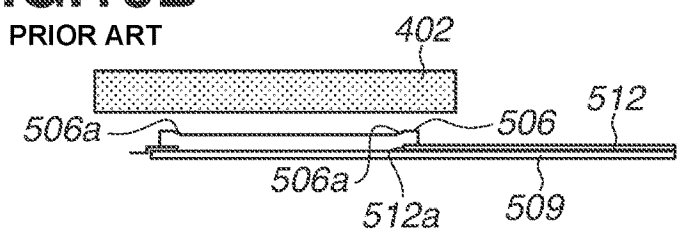
FIG.10B PRIOR ART
Figure 10C:
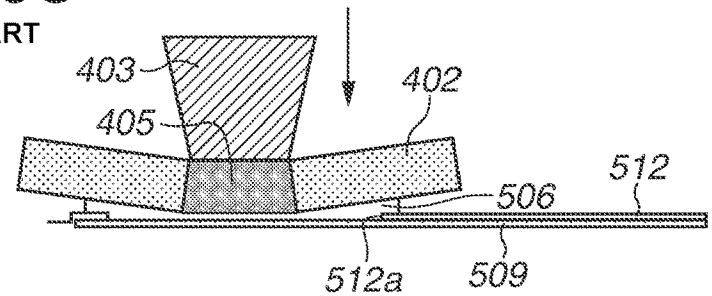
FIG.10C PRIOR ART
Figure 10D:
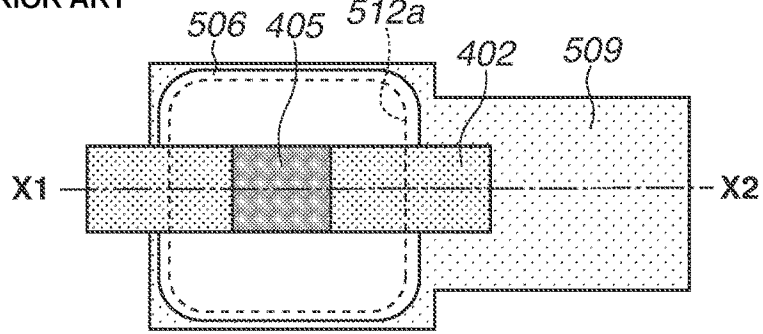
FIG.10D PRIOR ART
Figure 10E:
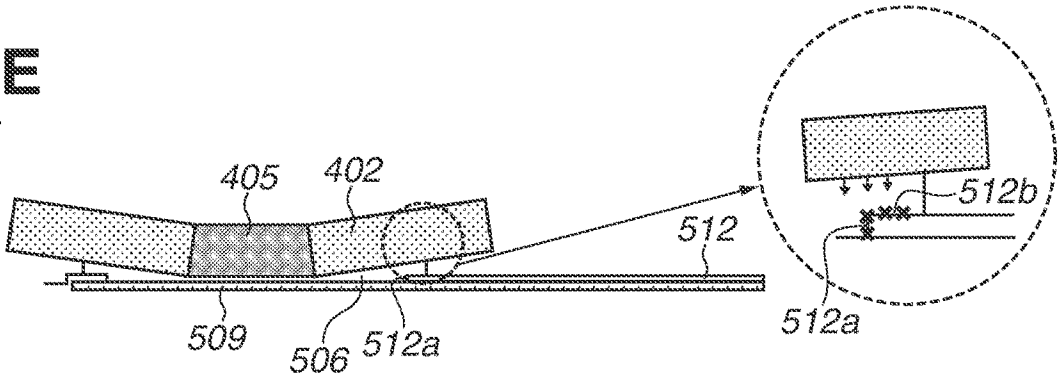
FIG.10E PRIOR ART

The issue will be specifically described with reference to FIGS. 10A to 10E. FIGS. 10A to 10E are diagrams for describing a connection between an electrode pad and a lead on a conventional liquid discharge head. FIG. 10A is a plan view illustrating a part of a liquid discharge head substrate in a state before the electrode pad is connected with the lead. FIG. 10B is a cross-sectional view taken along line X1-X2 in FIG. 10A. FIG. 10C is a cross-sectional view corresponding to FIG. 10B and illustrating a state where the lead is connected with the electrode pad by a bonding tool. FIG. 10D is a plan view illustrating the liquid discharge head substrate in a state after the electrode pad is connected with the lead. FIG. 10E is a cross-sectional view taken along line X1-X2 in FIG. 10D.

The liquid discharge head substrate includes an electrode pad 506 formed by, for example, gold (Au) bump plating. The electrode pad 506 is connected to an electrode 509 (for example, aluminum (Al) electrode) via a through hole 512*a* (broken line in FIG. 10A). The electrode 509 is disposed under the electrode pad 506. The through hole 512*a* is disposed in a protective film 512 that covers the electrode 509. The protective film 512 is not illustrated in the plan views of FIGS. 10A and 10D.

When the electrode pad 506 is to be connected with a wiring (lead) 402 on a tape automated bonding (TAB) substrate, the liquid discharge head substrate and an electric wiring member are disposed so that the wiring (lead) 402 is disposed astride the electrode pad 506 (FIGS. 10A and 10B). As illustrated in FIG. 10C, the wiring (lead) 402 is pressed against the electrode pad 506 by a bonding tool 403 (FIG. 10C). As a result, a connecting portion 405 with the electrode pad 506 is formed on a portion of the wiring (lead) 402 in contact with the bonding tool 403 (FIGS. 10C to 10E).

The bonding tool 403 is pushed with a proper load to securely connect the wiring (lead) 402 with the electrode pad 506. Accordingly, large forces are also applied to the wiring (lead) 402 and to a vicinity of the electrode pad 506 on the liquid discharge head substrate when the electrode pad 506 is to be connected with a wiring (lead) 402. A difference in level is generated on a surface of the electrode pad 506 between a portion astride the through hole 512*a* and a portion where the protective film 512 under the electrode pad 506 is present. For this reason, during the bonding, a load is easily applied intensively to a level difference portion 506*a* (FIG. 10B) of the electrode pad 506 via the wiring (lead) 402. As a result, as illustrated in a partial enlarged diagram of FIG. 10E, cracks 512*b* might be generated on a portion near the through hole 512*a* in the protective film 512 under the level difference portion 506*a* of the electrode pad 506. In particular, in a case where gang bonding is to be used for connection, a plurality of wirings (leads) 402 is to be simultaneously connected with a plurality of electrode pads 506, and for this reason, the bonding tool 403 which extends in an array direction of the electrode pads 506 is pushed with a larger load. Accordingly, the cracks 512*b* are more likely to be generated in the case where the gang bonding is used for the connection.

A cushioning property of the electrode pad 506 (for example, Au plating) is generally heightened by forming the electrode pad 506 with a large thickness of, for example, 5 μm to prevent the generation of the cracks 512*b*. A manufacturing cost, however, is increased if the electrode pad 506 has a larger thickness.

The present disclosure provides a liquid discharge head that can prevent the generation of cracks caused by the connection between electrode pads and wirings while reducing the manufacturing cost.

An exemplary embodiment of the present disclosure will be described.

Figure 1:
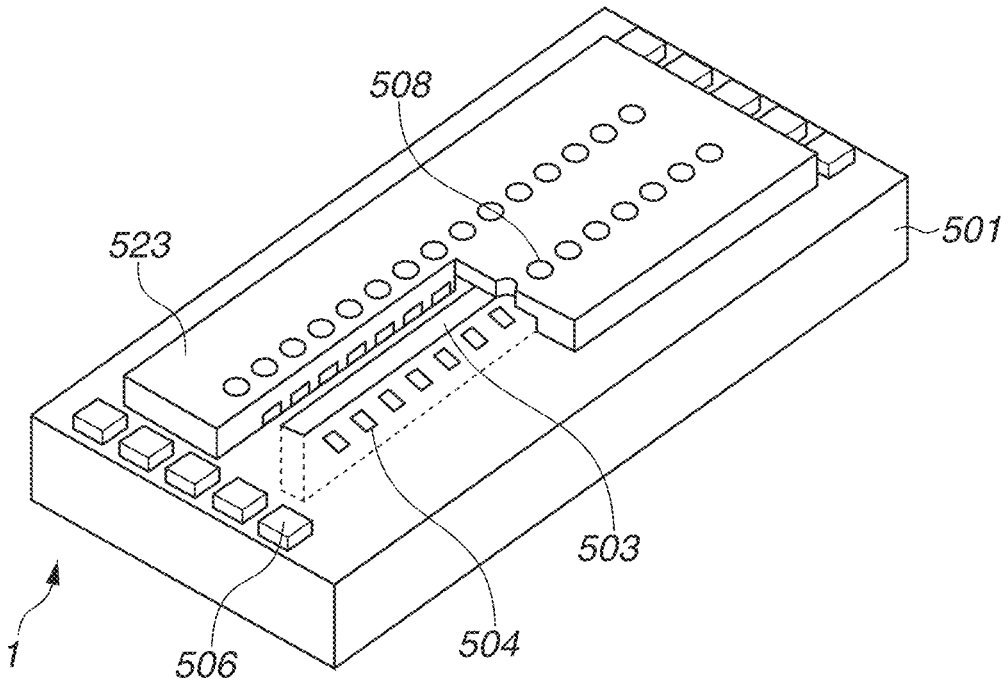
FIG. 1 is a diagram illustrating an example of a liquid discharge head substrate.
Figure 2:
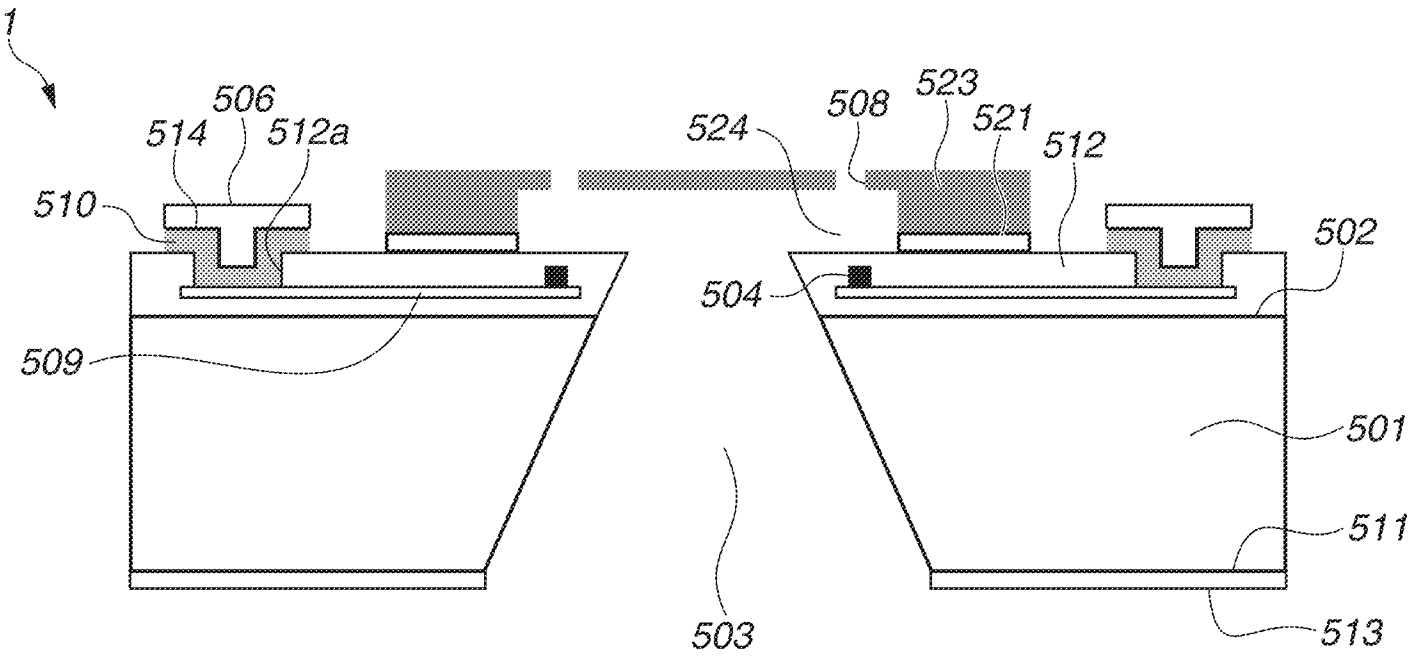
FIG. 2 is a cross-sectional view illustrating the liquid discharge head substrate.

FIG. 1 illustrates an example of a liquid discharge head substrate 1 to which the present exemplary embodiment is applicable. FIG. 2 is a cross-sectional view illustrating the liquid discharge head substrate 1.

The liquid discharge head substrate 1 includes a substrate 501 and a channel forming member 523. The substrate 501 is, for example, a silicon substrate having a thickness of 0.3 to 1.0 mm. The substrate 501 includes a slot-shaped supplying port 503 for supplying liquid from an outside into a liquid chamber 524. The supplying port 503 is a through hole that penetrates a first surface 502 and a second surface 511. The first surface 502 is a front surface of the substrate 501. The second surface 511 is a rear surface of the substrate 501 and is coated with an oxide film 513. A row of elements 504 that generate energy for discharging liquid is staggered on each side of the supplying port 503 on the first surface 502 of the substrate 501. The elements 504 are, for example, heat generating resistors.

The channel forming member 523 includes the liquid chamber 524 and a wall in which a channel for communication between the supplying port 503 and the liquid chamber 524 is formed. Discharge ports 508 are opened over the elements 504. The liquid chamber 524 is formed to contain the elements 504.

The elements 504 are electrically connected to the electrode 509 made of Al. The elements 504 and the electrode 509 are coated with the protective film 512 (coating film) made of silicon nitride (SiN) or silicon oxide ($SiO_2$).

The electrode pads 506 that electrically connect the liquid discharge head substrate 1 with an outside are disposed on the first surface 502 of the substrate 501. The plurality of rows of electrode pads 506 is arranged on both longitudinal ends of the liquid discharge head substrate 1. The electrode pads 506 are, for example, Au bumps formed by Au plating. A seed layer 514 and a diffusion prevention layer 510 which is made of titanium tungsten (TiW) are disposed under the electrode pads 506. The electrode pads 506 are connected with the electrode 509 via the through hole 512*a* formed in the protective film 512. A metal laminated film including the electrode pads 506, the seed layer 514 and the diffusion prevention layer 510 which are under the electrode pads 506, may be referred to as an electrode pad. Another electrode, not illustrated, made of Al may be disposed between the protective film 512 and the diffusion prevention layer 510. Also in this case, a metal laminated film including this electrode may be referred to as an electrode pad.

The elements 504 are driven by electric power supplied from the outside of the liquid discharge head substrate 1 via the electrode pads 506. Liquid supplied through the supplying port 503 into the liquid chamber 524 is discharged from the discharge ports 508 by the elements 504 being driven.

Figure 3:
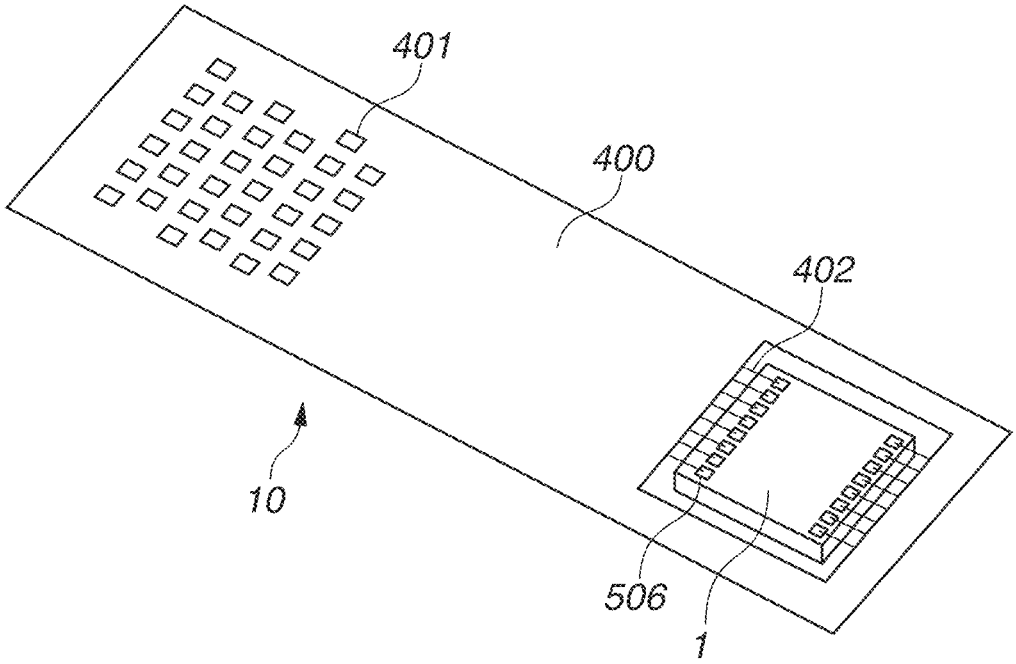
FIG. 3 is a diagram illustrating an example of a liquid discharge head.

FIG. 3 illustrates a liquid discharge head 10 (inkjet head) to which the present exemplary embodiment is applicable.

The liquid discharge head 10 includes the liquid discharge head substrate 1 as described above, and an electric wiring member 400 such as a tape automated bonding (TAB) substrate (flexible wiring substrate) for supplying electric power to the liquid discharge head substrate 1. The liquid discharge head substrate 1 is electrically connected with the electric wiring member 400 by bonding the electrode pads 506 disposed on the liquid discharge head substrate 1 to wirings 402 (for example, leads of the TAB substrate) disposed on the electric wiring member 400. It is preferable from the viewpoint of mass production that the connection between the electrode pads 506 and the wirings 402 is achieved by gang bonding for simultaneously connecting a plurality of electrode pads and a plurality of wirings corresponding to the plurality of electrode pads on one substrate. The electric wiring member 400 includes electrode pads 401. The electric wiring member 400 is electrically connected with a liquid discharge apparatus main body (not illustrated) via the electrode pads 401. The liquid discharge apparatus main body is mounted with a liquid discharge head cartridge.

Figure 4:
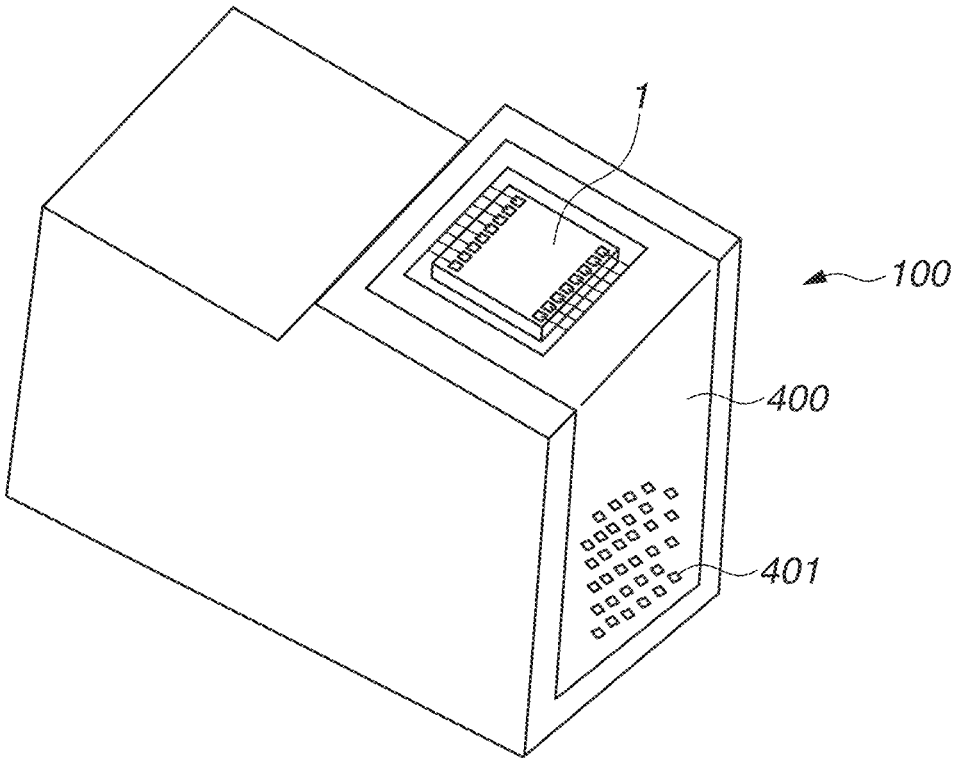
FIG. 4 is a diagram illustrating an example of a liquid discharge head cartridge.

FIG. 4 illustrates a liquid discharge head cartridge 100 including a tank for storing liquid. The electric wiring member 400, which has been connected with the liquid discharge head substrate 1, is bonded to a head cartridge main body. The liquid discharge head cartridge 100 is configured to supply liquid from the tank to the liquid discharge head substrate 1.

FIGS. 5A to 5F are diagrams for describing the connection between the electrode pad 506 and the wiring 402 on the liquid discharge head 10 to which the present exemplary embodiment is applicable.

Figure 5B:
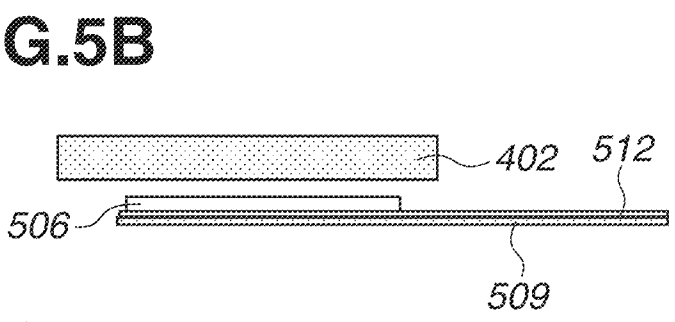
FIGS. 5A to 5F are diagrams for describing a connection between an electrode pad and a wiring on the liquid discharge head.
Figure 5D:
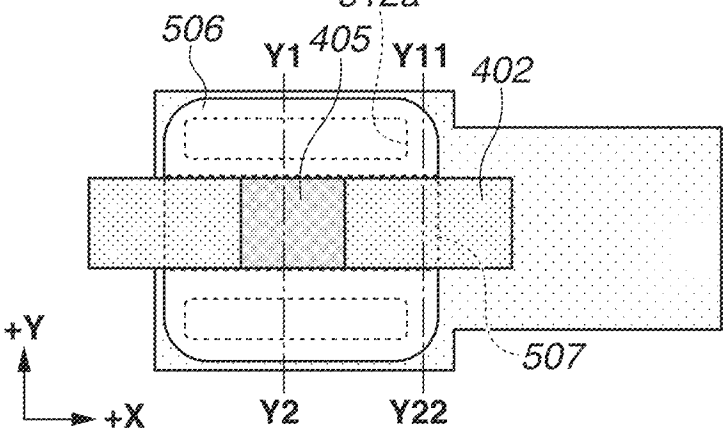
Figure 5F:
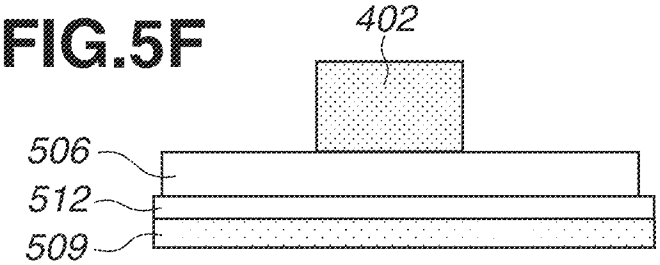
Figure 5A:
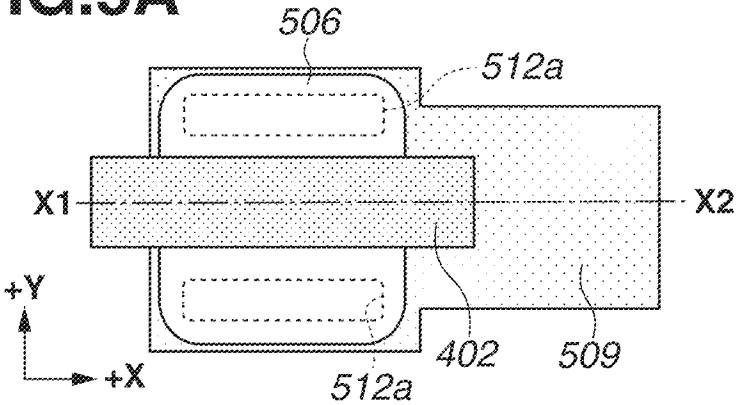
Figure 5C:
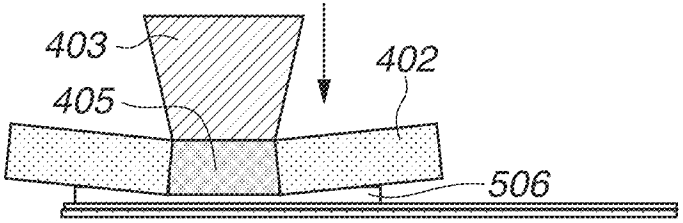
Figure 5E:
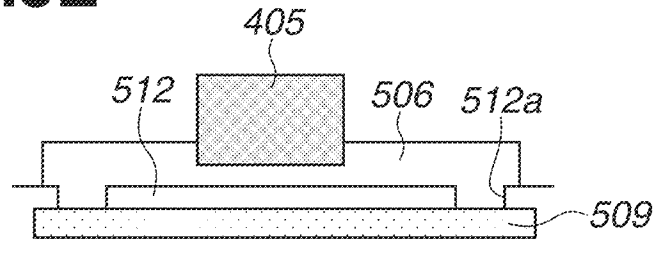

FIG. 5A is a plan view illustrating a part of the liquid discharge head substrate 1 in a state before the electrode pad 506 is connected with the wiring 402. FIG. 5B is a cross-sectional view taken along line X1-X2 in FIG. 5A. FIG. 5C is a cross-sectional view corresponding to FIG. 5B and illustrating a state where the wiring 402 is connected with the electrode pad 506 by the bonding tool 403 (pressing unit). FIG. 5D is a plan view illustrating the part of the liquid discharge head substrate 1 in a state after the electrode pad 506 is connected with the wiring 402. FIG. 5E is a cross-sectional view taken along line Y1-Y2 in FIG. 5D. FIG. 5F is a cross-sectional view taken along line Y11-Y22 in FIG. 5D. In the plan views of FIGS. 5A and 5D, the through holes 512*a* formed in the protective film 512 are indicated by broken lines for the sake of describing the connecting position at which the electrode pad 506 and the electrode 509 are connected with each other. The protective film 512 itself, however, is not illustrated. The seed layer 514 and the diffusion prevention layer 510 illustrated in FIG. 2 are not illustrated in FIGS. 5A to 5F.

As described above, in the configuration (FIGS. 10A to 10E) that the through holes 512*a* are disposed on a wide area under the electrode pad 506, a crack might be generated on a portion near the through hole 512*a* in the protective film 512 due to the connection between the electrode pad 506 and the wiring 402. Positions of the through holes 512*a* in the present exemplary embodiment are creative to prevent the generation of cracks. In other words, in the present exemplary embodiment, the through holes 512*a* are disposed at positions where the through holes 512*a* do not overlap a contact area 507 (FIG. 5D) where the electrode pad 506 and the wiring 402 are in contact with each other in a planar view of the liquid discharge head substrate 1.

In the present exemplary embodiment, the electrode pad 506 is to be connected with the wiring 402 as described below. The wiring 402 is disposed astride the electrode pad 506 (FIGS. 5A and 5B). At this time, the liquid discharge head substrate 1 and the electric wiring member 400 are disposed so that at least a part of the electrode pad 506 and at least a part of the wiring 402 overlap each other and an area where at least a part of the electrode pads 506 and at least a part of the wirings 402 overlap each other does not overlap the through holes 512*a* in the protective film 512.

The wiring 402 is pressed against the electrode pad 506 by the bonding tool 403 to push the opposite surface of the wiring 402 from the surface of the wiring 402 opposing the electrode pad 506 (FIG. 5C). As a result, a connecting portion 405 (bonding portion) to the electrode pad 506 is formed on a portion of the wiring 402 in contact with the bonding tool 403 (FIGS. 5C to 5F). The connecting portion 405 is pressure-bonded to the electrode pad 506, and is fused to the electrode pad 506 by being heated from the bonding tool 403. The wiring 402 in contact with the electrode pad 506 has a portion which is not directly pushed by the bonding tool 403. The portion, which is in contact with but is not bonded to the electrode pad 506, is a non-bonding portion.

When the wiring 402 is pushed against the electrode pad 506 by the bonding tool 403 illustrated in FIG. 5C, level difference portions generated on the electrode pad 506 due to presence and absence of the through holes 512*a* are not in contact with the wiring 402. In other words, an area of the electrode pad 506 that comes into contact with the wiring 402 during the connection does not have the level difference portions generated over the through holes 512*a*. This configuration can prevent a situation where a load to be applied to the bonding tool 403 is focused on the level difference portions of the electrode pad 506 via the wiring 402. Accordingly, the present exemplary embodiment can prevent the generation of cracks caused by connecting the electrode pad 506 and the wiring 402. The thickness of the electrode pad 506 does not have to be increased to prevent the generation of the cracks. Consequently, the manufacturing cost can be reduced.

In FIG. 5D, the wiring 402 is in contact with a center portion of the electrode pad 506 in a Y direction (that crosses a direction (X direction) in which the wiring 402 extends). The through holes 512*a* are disposed on both sides of a position shifted in the Y direction from the contact area 507 where the electrode pad 506 and the wiring 402 are in contact with each other. The present exemplary embodiment is not limited to this configuration.

Modifications which are different from the configuration of the electrode pad 506 and the through holes 512*a* illustrated in FIGS. 5A to 5F will be described with reference to FIGS. 6A to 6D. FIGS. 6A to 6D are plan views illustrating a part of the liquid discharge head substrate 1 in the state after the electrode pad 506 is connected with the wiring 402. All the modifications are similar to the above-described exemplary embodiment in that the through holes 512*a* are disposed at positions where the through holes 512*a* do not overlap the contact area 507 where the wiring 402 and the electrode pad 506 are in contact with each other.

Figure 6A:
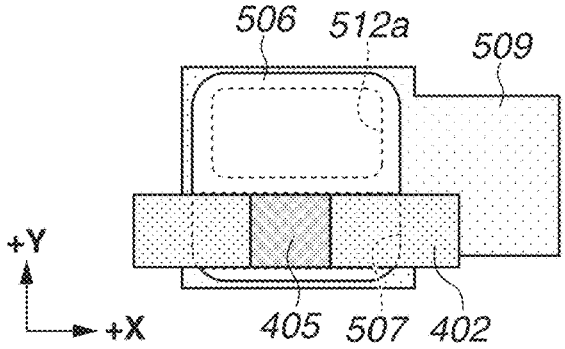
FIGS. 6A to 6D are diagrams illustrating other examples of the electrode pad on the liquid discharge head substrate.

In FIG. 6A, the contact area 507 where the wiring 402 and the electrode pad 506 are in contact with each other is disposed at a position shifted in a first direction along the Y direction (in FIG. 6A, minus Y direction) from the center portion of the electrode pad 506 in the Y direction. The through hole 512*a* is disposed at a position shifted from the contact area 507 in a direction opposite to the first direction (in FIG. 6A, plus Y direction). In addition to the effect of the above-described exemplary embodiment, the through hole 512*a* can be disposed on one side on the electrode pad 506 with respect to the wiring 402 in the present modification. As a result, a wide opening area of the through hole 512*a* is easily provided.

Figure 6B:
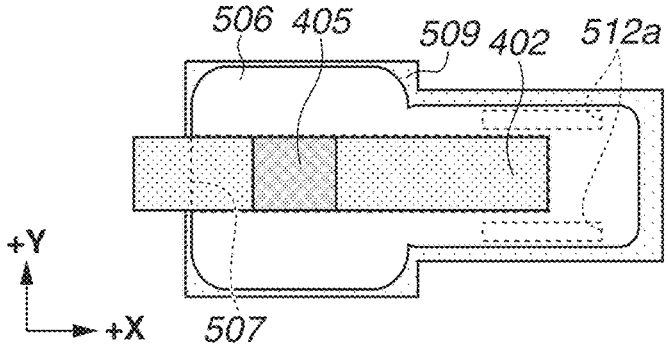
Figure 6C:
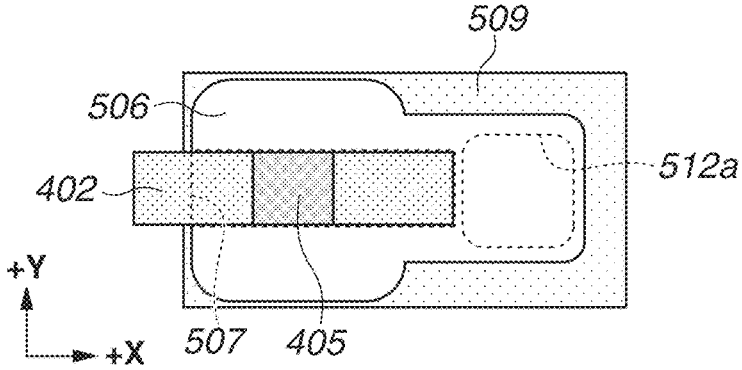

In FIGS. 6B and 6C, at least a part of the through hole 512*a* is disposed at a position shifted in the direction (X direction) in which the wiring 402 extends from the contact area 507 where the wiring 402 and the electrode pad 506 are in contact with each other. In the present modifications, unlike the configurations illustrated in FIG. 5D and FIG. 6A, the electrode pad 506 extends in the plus X direction. Accordingly, the through holes 512*a* are also disposed at positions shifted in the plus X direction. The present modifications are suitable for a case where the liquid discharge head substrate 1 has a space at a position shifted inwardly (plus X direction) from the end portion where the electrode pad 506 is disposed. The configuration in FIG. 6B or 6C may be selected based on a position of the end portion of the wiring 402 in the plus X direction. In other words, in a case where the through holes 512*a* partially overlap the contact area 507 in the X direction, as illustrated in FIG. 6B, it is preferable that the through holes 512*a* are separately disposed on both sides of the wiring 402. In a case where the through hole 512*a* does not overlap the contact area 507 in the X direction, as illustrated in FIG. 6C, one through hole 512*a* is disposed in an area which is extended in the plus X direction from the end portion of the wiring 402. In this way, the through hole 512*a* having a large opening area is easily provided.

Figure 6D:
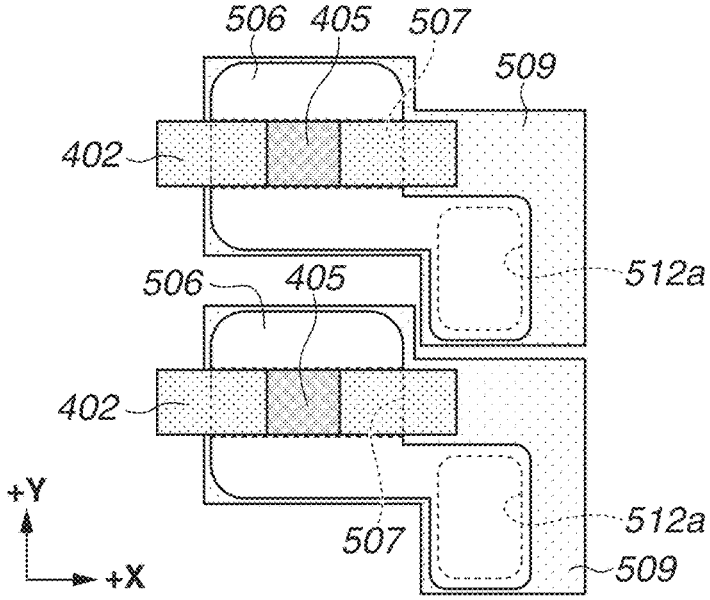

FIG. 6D illustrates a configuration that at least a part of one through hole 512*a* corresponding to one electrode pad 506 is disposed between the adjacent wirings 402 in an array direction (Y direction) in which the plurality of the wirings 402 is arrayed. The contact areas 507 where the electrode pads 506 and the wirings 402 are in contact with each other and the through holes 512*a* are staggered. More specifically, in FIG. 6D, the through holes 512*a* are disposed in the Y direction at a pitch approximately identical to a pitch between the wirings 402. In the Y direction, barycentric positions of the through holes 512*a* are shifted by a half pitch from barycentric positions of the connecting portions 405 where the wirings 402 and the electrode pads 506 are connected with each other. Such a configuration can both prevent an increase in size of the liquid discharge head substrate 1 and secure the areas for the through holes 512*a*. Instead of the configuration that the through hole 512*a* is disposed inwardly (plus X direction) from the end portion of the substrate with respect to the connecting portion 405, the through hole 512*a* can be disposed at an end portion (minus X direction) of the substrate 1 with respect to the connecting portion 405.

FIGS. 5A to 5F and FIGS. 6A to 6D illustrate the electrode pad 506 as a single-layer metal film, but as described above, the electrode pad 506 may be formed by stacking a plurality of metal films. A metal film on which the connecting portion 405 where the electrode pad 506 and the wiring 402 are connected with each other is formed among the metal films of the electrode pad 506 is a first metal film. A metal film in contact with the electrode 509 via the through hole 512*a* is a second metal film. At least the second metal film may overlap the through hole 512*a*. Accordingly, a planar shape of the first metal film may be different from a planar shape of the second metal film so that the first metal film does not overlap the through hole 512*a*. Such a configuration can, for example, reduce an area where Au is provided in a case where the first metal film is made of Au.

An example to which the present exemplary embodiment is applied will be described.

FIGS. 7A to 7E, 8A to 8E, and 9A to 9F are diagrams for describing steps of manufacturing the liquid discharge head substrate 1 according to the present example. FIGS. 7A to 7E, 8A to 8E, and 9A to 9F are cross-sectional views illustrating the liquid discharge head substrate 1 including the through holes 512*a* in the protective film 512.

Figure 7A:
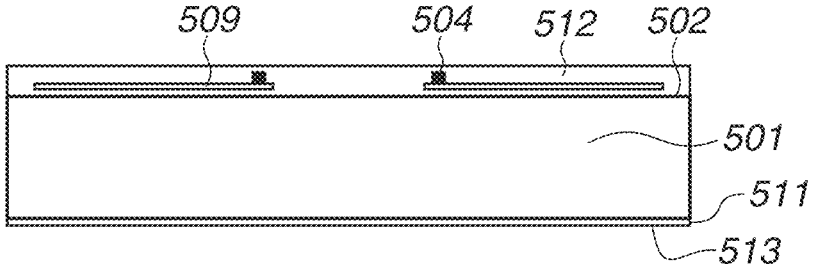
FIGS. 7A to 7E are diagrams for describing steps of manufacturing the liquid discharge head substrate.

As illustrated in FIG. 7A, the substrate 501 was prepared. The substrate 501 included the elements 504 made of tantalum silicon nitride (TaSiN) and configured to generate energy for discharging liquid toward the first surface 502. A silicon (1.0.0) substrate was used as the substrate 501. The substrate 501 included the protective film 512 and the oxide film 513. The protective film 512 was formed of SiN on a top layer of the first surface 502. The oxide film 513 was formed by thermal oxidization on the second surface 511 which was a surface of the substrate 501 opposite to the first surface 502. The protective film 512 was an insulating protective film that covered the elements 504 and the electrode 509 mainly containing Al. The electrode 509 was electrically connected with the elements 504.

Figure 7B:
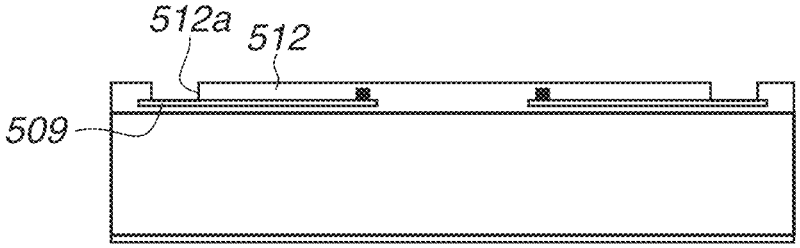

As illustrated in FIG. 7B, the protective film 512 was dry-etched into a predetermined shape using photolithography. Photoresist resin manufactured by Tokyo Ohka Kogyo Co., Ltd. with a thickness of 1 μm was formed on the entire surface of the substrate 501 using a spin coating method, and was partially exposed by using a pattern mask and an exposing device. Thereafter, the photoresist resin was developed, and only an electrode portion on the substrate 501 was exposed. The protective film 512 was partially dry-etched, and then resist was removed by ashing using oxygen plasma. In such a manner, the electrode 509 was partially exposed from the through holes 512*a* in the protective film 512. Like the above-described exemplary embodiment, the through holes 512*a* were disposed not to overlap the contact area where the leads of the TAB substrate to be connected afterward and the electrode pads 506 to be formed afterward are in contact with each other.

Figure 7C:
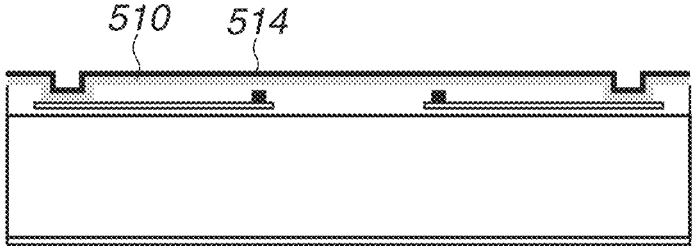
Figure 7D:
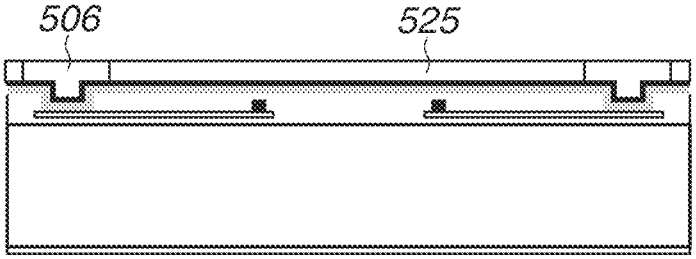

Thereafter, plating was performed for forming Au bump plating. In other words, as illustrated in FIG. 7C, TiW was selected to be deposited into a thickness of 400 nm as the diffusion prevention layer 510 made of Au using a sputtering method. Then, Au to be the seed layer 514 plated with gold was deposited into a thickness of 50 nm using the sputtering method. Thereafter, as illustrated in FIG. 7D, a resist 525 for plating manufactured by Tokyo Ohka Kogyo Co., Ltd. was used to form a plating pattern by exposure using a mask and an exposing device and by development. Au plating for forming the electrode pads 506 was formed into a height of 1 μm.

Figure 7E:
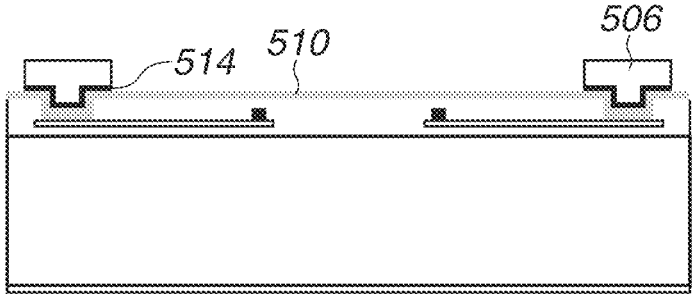

Thereafter, as illustrated in FIG. 7E, the resist 525 was peeled by using a resist peeling solution (product name: Remover 1112A) manufactured by Rohm and Haas, and the seed layer 514 formed on the entire surface of the substrate 501 was removed by using an iodine solution. The diffusion prevention layer 510 was then etched using hydrogen peroxide.

Figure 8A:
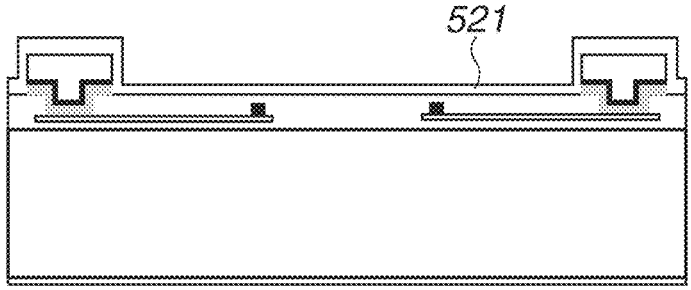
FIGS. 8A to 8E are diagrams for describing steps of manufacturing the liquid discharge head substrate.
Figure 8B:
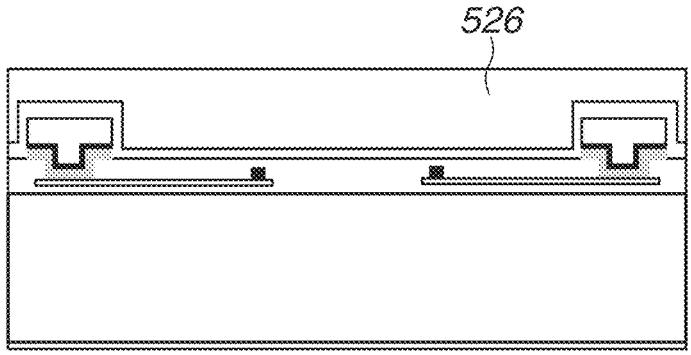
Figure 8C:
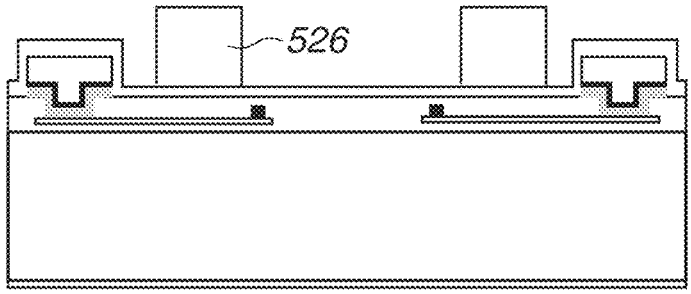
Figure 8D:
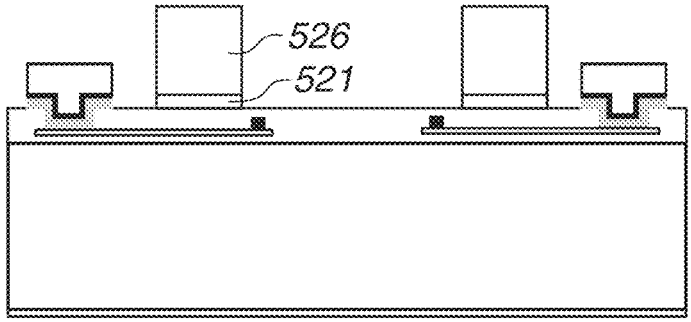
Figure 8E:
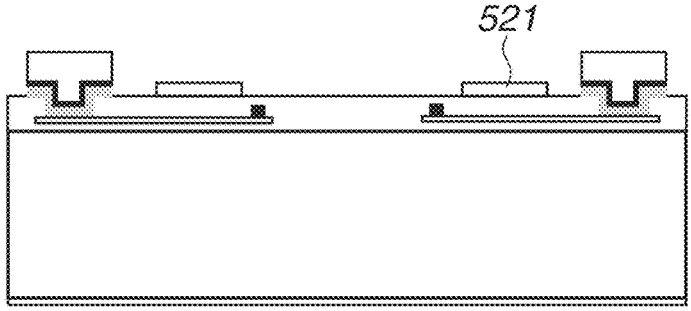

As illustrated in FIG. 8A, an adhesion improving layer 521 for improving adhesion between the substrate 501 and the channel forming member to be disposed afterward was provided. The adhesion improving layer 521 was formed into a thickness of 2 μm by using HIMAL (trade name) manufactured by Hitachi Chemical Co., Ltd. by the spin coating method. A pattern could not be formed by exposure and development using the HIMAL. For this reason, as illustrated in FIG. 8B, a photoresist 526 manufactured by Tokyo Ohka Kogyo Co., Ltd. for forming the adhesion improving layer 521 was applied into a thickness of 5 μm using the spin coating method. Thereafter, the photoresist 526 was partially exposed by using a pattern mask and the exposing device, and was developed. As a result, the resist 526 was formed into a predetermined shape as illustrated in FIG. 8C. As illustrated in FIG. 8D, the adhesion improving layer 521 was partially dry-etched. The resist 526 was then removed using the resist peeling solution (product name: Remover 1112A) made by Rohm and Haas. As illustrated in FIG. 8E, the HIMAL was formed into a predetermined shape as the adhesion improving layer 521.

Figure 9A:
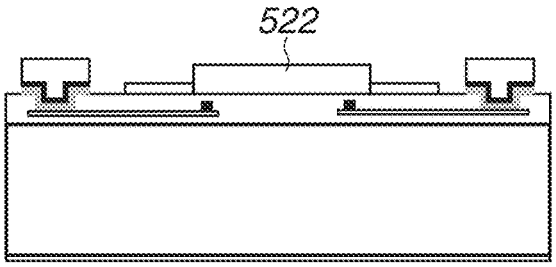
FIGS. 9A to 9F are diagrams for describing steps of manufacturing the liquid discharge head substrate.

As illustrated in FIG. 9A, a mold material 522 for forming a space to be the liquid chamber 524 was formed into a thickness of 5 μm to 70 μm using soluble resin by the spin coating method. The mold material 522 was then exposed by an exposing device (product name: UX-3300 manufactured by Ushio Inc.) and was developed. Thus, a predetermined pattern was formed. Specifically, the resin having a thickness of 20 μm to be the mold material 522 was exposed using DeepUV light having an exposure wavelength of less than or equal to 400 nm with an exposure dose of 5000 J/m$^2$, and was developed. The resin was then baked at 50° C. for 5 minutes. As a result, a pattern to be a channel and the liquid chamber 524 was formed.

Figure 9B:
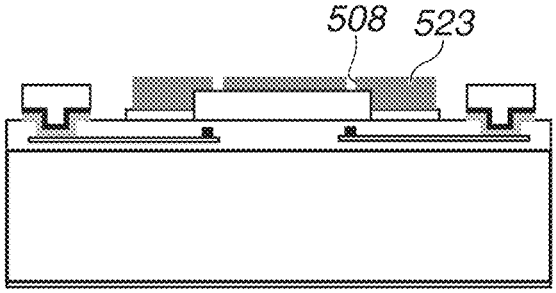

As illustrated in FIG. 9B, the channel forming member 523 for forming the discharge ports 508 for discharging ink and the liquid chamber 524 was formed into a thickness of 15 μm on the substrate 501 by the spin coating method. As the channel forming member 523, a solution obtained in the following manner was used. Epoxy resin (product name: 157S70 manufactured by Japan Epoxy Resin Co., Ltd.) and a photoacid generating agent (product name: LW-S1 manufactured by San-Apro Ltd.) were dissolved in xylene. This solution was applied by the spin coating method. A film thickness of the channel forming member 523 on the mold material 522 was 10 μm. A film thickness of the channel forming member 523 on the other portions was 15 μm. Thereafter, the channel forming member 523 was exposed with a pattern by an exposing device (product name: FPA-3000i5+ manufactured by Canon Inc.) with an exposure wavelength of 365 nm and an exposure dose of 20 J/cm$^2$. The channel forming member 523 was then developed and baked at 90° C. for 5 minutes. As a result, the discharge ports 508 were formed.

Figure 9C:
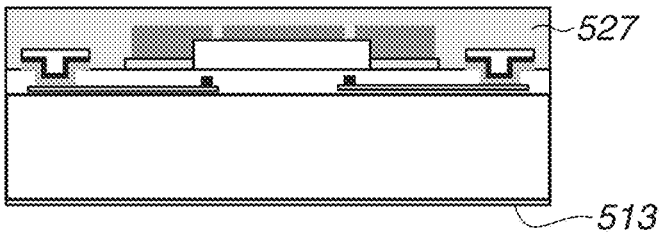

As illustrated in FIG. 9C, a cyclized rubber 527 for protecting a surface was applied to have a thickness of 40 μm and to cover the surface of the substrate 501 by the spin coating method. The cyclized rubber 527 was baked at 90° C. for 30 minutes to be cured. The cyclized rubber 527 was used as a film that protects the surface of the substrate 501 during anisotropic etching of a silicon substrate using a tetramethyl ammonium hydroxide (TMAH) alkali solution in a subsequent step. A photoresist (manufactured by Tokyo Ohka Kogyo Co., Ltd.) to be a pattern mask for etching the oxide film 513 on the rear surface of the substrate 501 was applied to the rear surface of the substrate 501 into a thickness of 1 μm by the spin coating method. The photoresist was exposed by the exposing device, was developed, and thus a predetermined pattern was formed. Thereafter, the oxide film 513 was partially removed using buffered hydrofluoric acid, and the resist was peeled. Consequently, an opening for forming the supplying port 503 was formed in the oxide film 513.

Figure 9D:
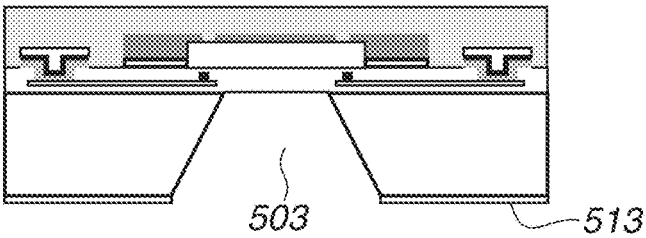
Figure 9E:
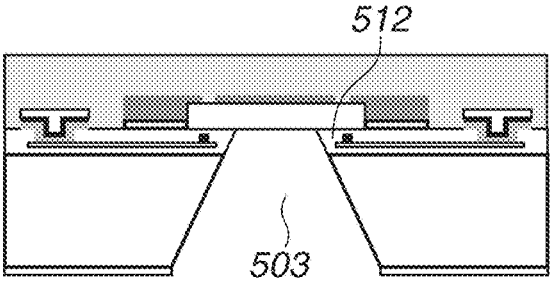
Figure 9F:
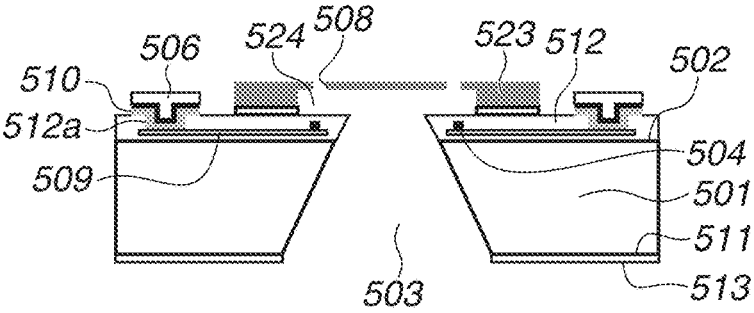

As illustrated in FIG. 9D, the alkali solution containing 20% of TMAH was heated to 83° C., and anisotropic etching was performed on the silicon substrate. Consequently, the supplying port 503 was formed. As illustrated in FIG. 9E, a film such as the protective film 512 on the surface above the supplying port 503 was etched to be removed using buffered hydrofluoric acid. The cyclized rubber 527 was then dissolved to be removed using xylene, and the mold material 522 was dissolved to be removed using methyl lactate. As a result, the supplying port 503, the liquid chamber 524, and the discharge ports 508 were communicated with each other. Thereafter, curing was performed at 200° C. for 1 hour, and thus the liquid discharge head substrate 1 illustrated in FIG. 9F was finished.

The electrode pads 506 on the liquid discharge head substrate 1 formed as described above were connected with the wirings (leads) 402 on the TAB substrate as the electric wiring member 400 using gang bonding. In the present example, the thickness of the Au plating bumps of the electrode pads 506 was reduced from 5 μm, conventional value, to 1 μm, to reduce the manufacturing cost. However, no crack was generated near the through holes 512*a* after the bonding.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-025706, filed Feb. 15, 2019, which is hereby incorporated by reference herein in its entirety.

What is claimed is:

1. A liquid discharge head comprising:

a liquid discharge head substrate including an element configured to discharge liquid, an electrode electrically connected to the element, an insulating coating film having a through hole and configured to cover the electrode, and an electrode pad configured for electrical connection with an outside and connected with the electrode via the through hole, the electrode pad being disposed on a side of the insulating coating film opposite to a side of the insulating coating film opposing the electrode;

an electric wiring member including a wiring bonded to the electrode pad;

a bonding portion where the electrode pad and the wiring are in contact with each other and bonded to each other; and a non-bonding portion where the electrode pad and the wiring are in contact with each other but not bonded to each other, wherein the bonding portion and the non-bonding portion are disposed at positions where the bonding portion and the non-bonding portion overlap the electrode and the insulating coating film but do not overlap the through hole in a planar view of the liquid discharge head substrate.

2. The liquid discharge head according to claim 1, wherein the through hole is disposed at a position shifted from a contact area where the electrode pad and the wiring are in contact with each other in a direction crossing a direction in which the wiring extends in the planar view of the liquid discharge head substrate.

3. The liquid discharge head according to claim 2, wherein the contact area is disposed on a center portion of the electrode pad in the crossing direction and through holes are disposed on both sides of the position shifted from the contact area in the crossing direction in the planar view of the liquid discharge head substrate.

4. The liquid discharge head according to claim 2, wherein the contact area is disposed at a position shifted from a center portion of the electrode pad in the crossing direction in a first direction along the crossing direction and the through hole is disposed at a position shifted from the contact area in a direction opposite to the first direction in the planar view of the liquid discharge head substrate.

5. The liquid discharge head according to claim 1, wherein at least a part of the through hole is disposed at a position shifted from the contact area where the electrode pad and the wiring are in contact with each other in a direction in which the wiring extends in the planar view of the liquid discharge head substrate.

6. The liquid discharge head according to claim 1, wherein the liquid discharge head substrate includes a plurality of electrode pads, and the electric wiring member includes a plurality of wirings disposed along an array direction of the plurality of electrode pads and bonded to the plurality of electrode pads, the plurality of wirings comprising wirings adjacent to each other in the array direction and wherein the through hole is disposed at a position where at least a part of the through hole is disposed between the wirings adjacent to each other in the array direction and contact areas where the plurality of electrode pads and the plurality of wirings are in contact with each other and through holes are staggered in the array direction in the planar view of the liquid discharge head substrate.

7. The liquid discharge head according to claim 1, wherein the electric wiring member is a flexible wiring substrate, and the wiring is a lead disposed on the flexible wiring substrate.

8. The liquid discharge head according to claim 1, wherein a contact area where the electrode pad and the wiring are in contact with each other includes a part of an edge portion of the electrode pad.

9. The liquid discharge head according to claim 1, wherein the electrode pad contains gold (Au) and has a thickness of less than or equal to 1 μm.

* * * * *